US006209421B1

(12) United States Patent
Thiele

(10) Patent No.: US 6,209,421 B1
(45) Date of Patent: Apr. 3, 2001

(54) ROOF SHINGLE REMOVER

(76) Inventor: Todd Thiele, 2803 Deer Path Trail, Janesville, WI (US) 53545

( * ) Notice: Subject to any disclaimer, the term of this patent is extended or adjusted under 35 U.S.C. 154(b) by 0 days.

(21) Appl. No.: 09/431,111

(22) Filed: Nov. 1, 1999

(51) Int. Cl.[7] ..... E04D 15/00
(52) U.S. Cl. ..... 81/45; 299/36.1
(58) Field of Search ..... 81/45, 46; 254/15, 254/17, 21, 120, 121, 131, 131.5; 299/36.1

(56) References Cited

U.S. PATENT DOCUMENTS 322,019 * 7/1885 Spencer ..... 254/131
880,210 * 2/1908 Gloner ..... 254/21
1,296,738 * 3/1919 Bekke ..... 254/131.5
2,655,399 * 10/1953 McMillan ..... 254/131 X
3,504,578 * 4/1970 Shannon et al. ..... 254/131

* cited by examiner

*Primary Examiner*—D. S. Meislin
(74) *Attorney, Agent, or Firm*—Howard M. Herriot

(57) ABSTRACT

An improved hand tool for removing shingles and accompanying roofing material from skip sheeting roof boards. The tool has a handle shank 11 with a drop leg 20 extending down from its front end. A prong 21 extends forwardly from the lower end of drop leg 20. A U-shaped structure 3 has its bight 30 connected to the drop leg 20 with its legs 31 and 32 extending forwardly parallel to and above the prong 21 which is positioned centrally beneath legs 31 and 32. A cross bar 4 connects the forward ends of legs 31, 32, and a brace 12 connects the center of cross bar 4 to the front of handle shank 11. The prong 21 is inserted into the gap between adjacent roof boards and advanced forwardly. The shingles are lifted and trapped between prong 21 and legs 31, 32. As the handle shank is lifted and worked upwardly and downwardly while advancing, the shingles and accompanying material are thus removed from the roof boards.

1 Claim, 4 Drawing Sheets

ROOF SHINGLE REMOVER

BACKGROUND

1. Field of Invention

This invention relates to hand tools for removing shingles in single or multiple layers, from existing roofs, laid over skip sheeting boards.

2. Description of Prior Art

Shingle removing tools of various configurations have been suggested by the prior art, such as Mills U.S. Pat. No. 3,987,827, Whitesell U.S. Pat. No. 5,159,859, Wirth U.S. Pat. No. 5,495,781, Harpell U.S. Pat. No. 5,836,222 and Carroll U.S. Pat. No. 5,893,304. However, none of these prior art devices have a structure above and parallel to a lower insertion prong that inserts in the gap between sheeting boards, so that shingles are more effectively removed from the skip sheeting boards. Wirth discloses a prying tool with a prong or tongue that may be inserted in the gap and with arms extending laterally out on each side of the rear end of the tongue, but the arms are in the same horizontal plane as the tongue; they are not spaced above and parallel to the tongue; and they are positioned only at the rear of the tongue, they do not extend the entire length of the tongue. Wirth's arms act as a fulcrum to provide lifting movement to the tongue as the tool handle shank is moved down, forcing the tongue up to lift off the roofing material; they cannot act as a fulcrum to provide pry-lifting movement to the tongue as the tool handle is moved up.

OBJECTS AND ADVANTAGES

An object of my invention is to provide a tool that effectively removes wood shake shingles and any overlying second layer of roofing from skip sheeting roof boards, by utilizing an insert prong that may be inserted into the gap between the roof boards, and a structure fixed above and parallel to the prong, extending over, and to the left and right of, the prong, so that when the handle shank of the tool is worked to lift the prong, the upper overlying structure above the prong, may act as a fulcrum for pry-lifting the prong, and may also act as a trap for trapping the shingles between the lower prong and the upper structure. Another object is to provide an upper structure that overlies substantially the entire length of the prong, so that the structure may be a fulcrum at its rear end for pry-lifting the forward part of the prong by moving the handle shank down, and may also be a fulcrum at its front end for lifting the rearward part of the prong by moving the handle shank up. The upper structure acts as a barrier or trap, trapping the roofing material to be removed between the lower prong and the upper structure, and thus very effectively removes the roofing material. These and other objects and advantages will become apparent from the ensuing description and drawings.

DRAWING FIGURE

DETAILED DESCRIPTION

Figure 1:
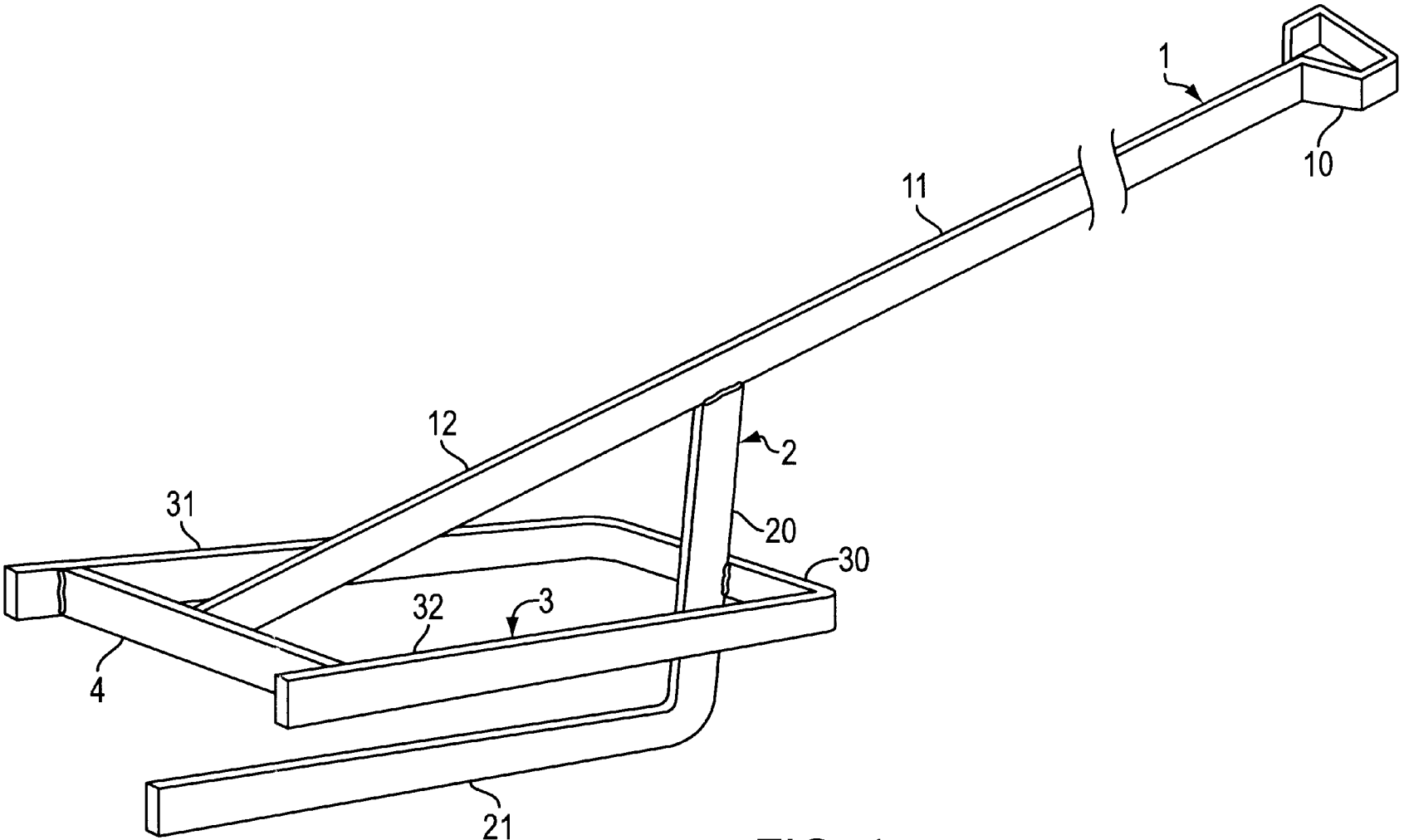
FIG. 1 is an isometric view of a shingle removing tool embodying my invention, with a portion of the handle piece removed.
Figure 2:
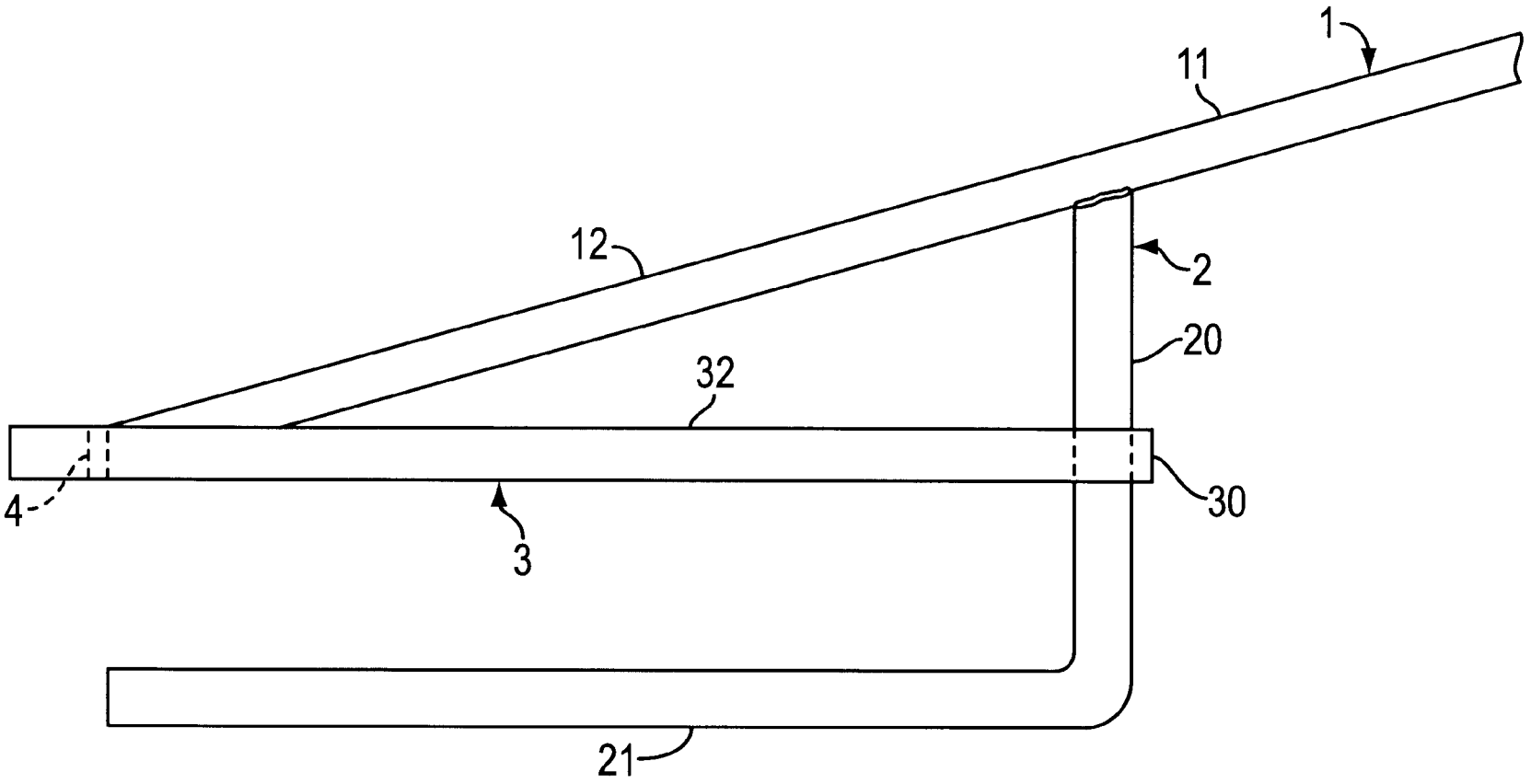
FIG. 2 is a side elevation view.
Figure 3:
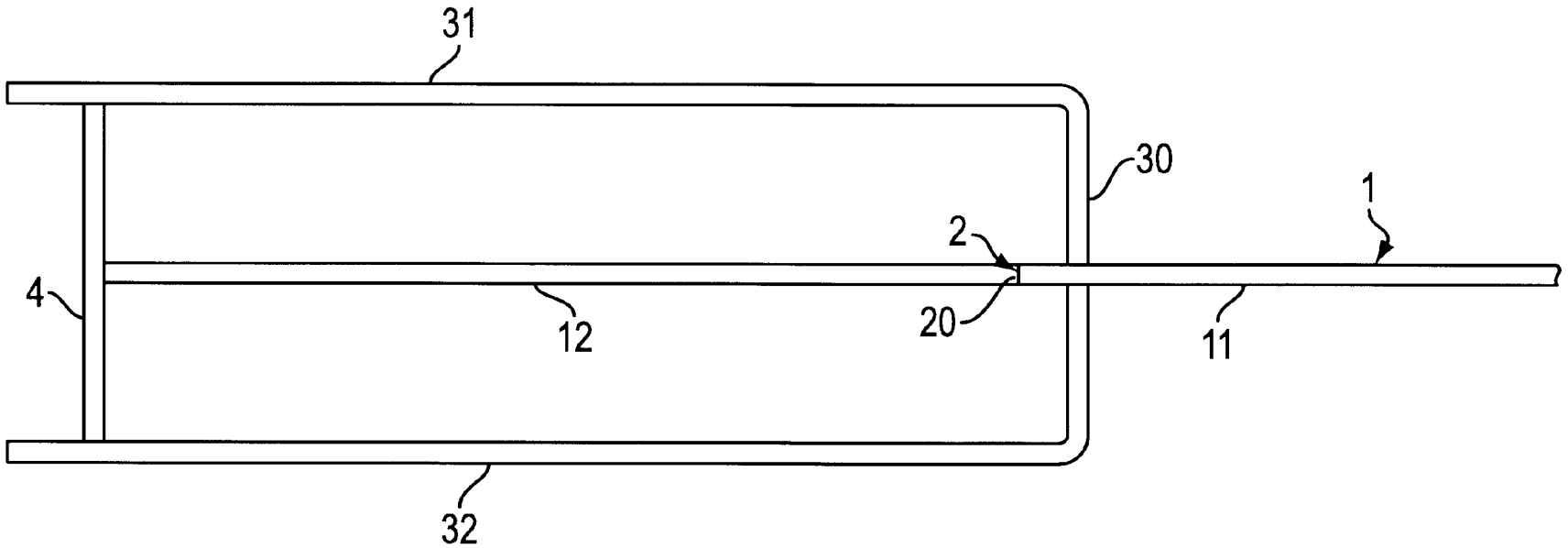
FIG. 3 is a top plan view.
Figure 5:
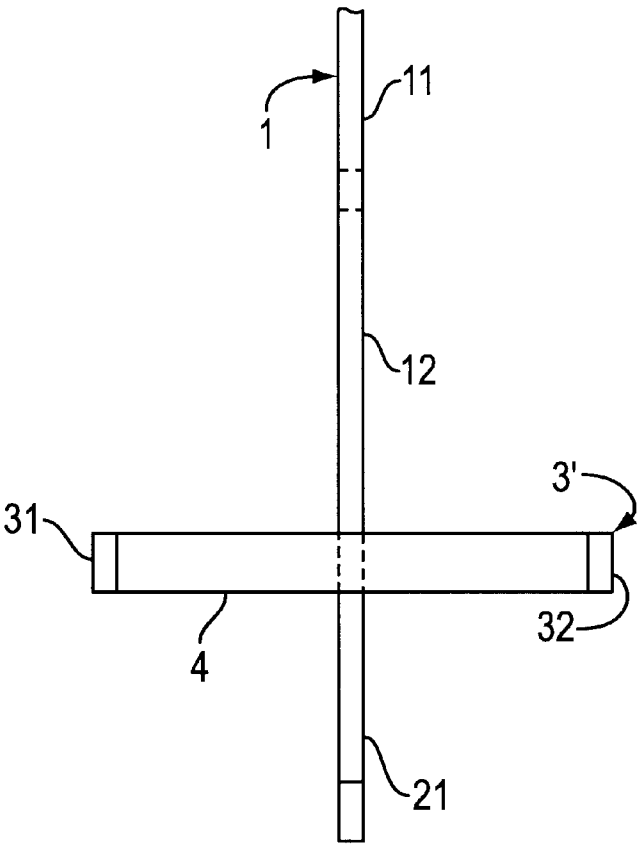
FIG. 5 is a front elevation view.
Figure 4:
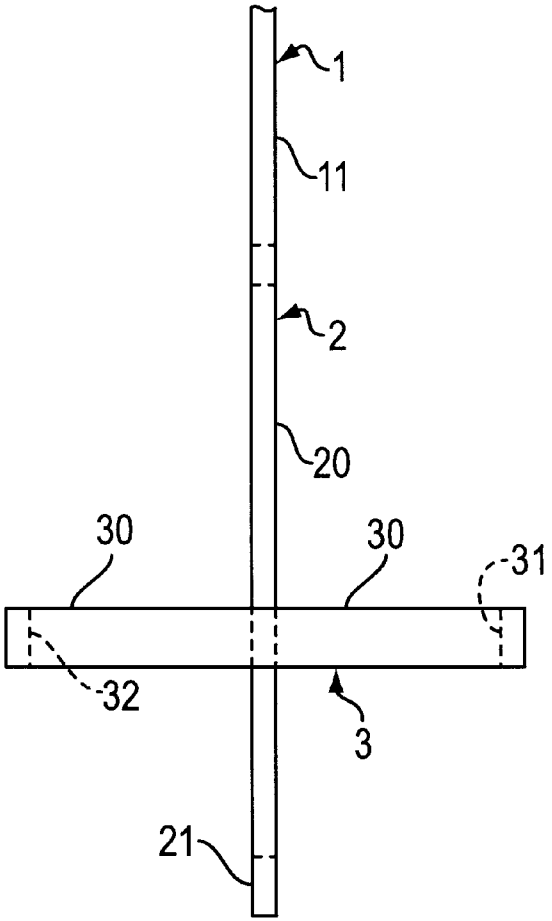
FIG. 4 is a rear elevation view.

The tool of my invention is shown constructed entirely of four pieces of rectangular cross section, one-half inch by one-eighth inch steel bar stock. The pieces are welded together. It may if desired be constructed of heavier stock, or indeed, of round bar stock or other cross section stock.

A straight, long piece 1 has a handle grip 10 formed at its read end, and has a central handle shank portion 11 and a forward brace portion 12.

An L-shaped piece 2 has a vertical drop leg portion 20 and a horizontal prong portion 21 extending forwardly from the bottom end of the drop leg portion 20 at substantially a right angle. The angle between drop portion 20 and handle shank 11 is about seventy-five degrees. The top of the drop portion 20 is welded to long piece 1 at the rear of brace portion 12 and the front of handle shank portion 11.

A U-shaped piece 3 has a rear cross bar bight portion 30, a forwardly extending right arm 31 and a forwardly extending left arm 32. The bight portion 30 is, at about its midpoint, welded to drop portion 20 at about the midpoint thereof. Arms 31 and 32 are parallel to each other and parallel to prong 21. Prong 21 lies below and centrally between arms 31 and 32. The rectangular structure formed by U-shaped piece 3 and cross-bar 4 extend to each side of prong 21 and overlie the entire length of prong 21.

Near the front of arms 31, 32 a front cross bar piece 4 is welded at its ends to join with arm 31 on the right and arm 32 on the left. Brace portion 12 of long piece 1 is welded at its front end to the center of cross bar 4 and extends in axial alignment rearwardly with handle shank 11. Arms 31 and 32 each extend forwardly slightly beyond the forward end of prong 21.

U-shaped piece 3, together with cross bar 4, form a rectangular frame-like upper structure spaced above prong 21 and parallel thereto, which extends to each side of prong 21 and over the entire length of prong 21.

Instead of the handle shank and handle grip being of the same piece, the handle shank may if desired, be embedded into a conventional wooden shovel handle having a standard rear end handle grip structure. If desired, the brace 12 may be a separate piece rather than part of the same piece as the handle shank.

The overall length of the tool preferably is about ordinary scoop shovel length. The drop portion 20 of the L-shaped piece is preferably about from 5 to 9 inches high. The prong portion 21 of the L-shaped piece is preferably about from 12 to 16 inches long. The U-shaped piece 30 is preferably about from 13 to 17 inches long and about from 4 to 8 inches wide. The vertical spacing between the prong portion 21 and the arms 31, 32 is preferably from 2 to 4 inches.

OPERATION

In operation of the tool, one preferably starts at the top ridge of the roof, near one end thereof, tearing enough roofing away to expose a gap between adjacent skip sheeting roof boards. The prong 21 is inserted into the gap and advanced therein under the shingles. The handle shank 11 is thus advanced forwardly and may be worked with mostly a lifting movement and also may be worked upwardly and downwardly as the prong is advanced. This provides pry-lifting motion of the prong 21. The shingles to be removed are trapped between the prong 21 and the upper rectangular structure of arms 31, 32, front cross bar 4, and rear cross bar 30. When moving the handle shank 11 up, the front end of the upper structure acts as a fulcrum to move the rearward portion of prong 21 upwardly. When moving the handle shank 11 down, the rear end of the upper structure acts as a fulcrum to move the forward portion of prong 21 upwardly. By so working the handle shank, the shingles are lifted from the roof boards and discarded. This operation is continued across the roof and then repeated at a lower level, and so on, until all the shingles are removed and discarded The scope of the invention is to be determined not only from the embodiments disclosed, but also and mainly by the claims set forth below.

I claim:

1. A shingle removing tool for loosening, lifting and removing shingles from gapped roof boards, said tool having no moving parts and comprising:

a handle shank;

a drop leg extending downwardly from a forward end of said shank, the angle between said shank and said drop leg being about seventy-five degrees;

a prong extending forwardly from a lower end of said drop leg for inserting into the gap between roof boards, the angle between said prong and said drop leg being about ninety degrees; and a structure connected to said drop leg and extending forwardly therefrom over and to each side of said prong, said structure extending from said drop leg substantially the same distance as said prong and being substantially rectangular in shape and being substantially parallel to said prong and being connected at its rear end to said drop leg at about the midpoint of said drop leg.

* * * * *